US005237814A

United States Patent [19]

Chen

[11] Patent Number: 5,237,814

[45] Date of Patent: Aug. 24, 1993

[54] INTERNAL COMBUSTION ROTARY ENGINE

[76] Inventor: Suh P. Chen, No. 3, Lane 23, Wanking St., Wenshan Dist., Taipei, Taiwan

[21] Appl. No.: 713,383

[22] Filed: Jun. 11, 1991

[51] Int. Cl.[5] ..... F02C 13/00

[52] U.S. Cl. ..... 60/39.75; 60/268; 60/39.34

[58] Field of Search ..... 60/39.75, 268, 39.35, 60/39.34

[56] References Cited

U.S. PATENT DOCUMENTS 4,912,924 4/1990 Stockwell ..... 60/39.75

FOREIGN PATENT DOCUMENTS 381193 10/1932 United Kingdom ..... 60/39.75

*Primary Examiner*—Richard A. Bertsch
*Assistant Examiner*—W. J. Wicker

[57] ABSTRACT

An internal combustion rotary engine has a housing which has a plurality of outer rotors and stators and bearings, the outer rotors having a plurality of curved channels on inner surfaces thereof and one of the stators having intake ports and a port for a spark plug; a shaft which is rotatably supported by the bearings and has a plurality of holes communicating with a center passage formed therein for flowing of a coolant; a central rotor being formed as a frustum and fixedly supported by the shaft and having a plurality of curved channels overlapping with the channels on the rotors at ends thereof, but in a reversed direction, and on a first conical surface at a middle portion thereof and a second conical surface with a larger slope than the first conical surface at a front portion thereof to define a combustion chamber.

11 Claims, 8 Drawing Sheets

INTERNAL COMBUSTION ROTARY ENGINE

BACKGROUND OF THE INVENTION

This invention relates to an internal combustion rotary engine.

A rotary engine is known as utilizing a rotor which is enclosed in a chamber and rotated by an expanding ignited gas to convert heat energy into mechanical energy in order to perform work. The motion of the rotor classifies known rotary engines into different types, such as:

(1) A single rotating engine—the rotor rotates at a certain angular velocity and the center of its rotation does not move. A typical example is the Malloy engine (United States), which rotor is divided by a number of vanes, rotates eccentrically in the chamber.

(2) An oscillatory rotating engine—a plural number of rotors around the center of rotating by changing their angular velocity, and the chamber volume as the rotors come close to each other or separate from each other. A typical example is the Kauertz's engine.

(3) A planetary rotating engine—a rotor rotates in a enclosed chamber which makes a planetary motion. The NSU-Wankel engine is installed in Mazda sport cars, which manufactured by Toyo Kogyu Co., Ltd. Japan.

However, the rotary engines mentioned above complete four strokes during one cycle in the enclosed space: intake, compression, power (or combustion), and exhaust. To separate the four strokes, it has to use apex seals or blades to perform an separating effect, and motor oil to reinforce a gas tight seal and lubrication between surfaces of the rotor and stator. Such a construction solves problems of power stroke, meanwhile induces disadvantages, e.g., mechanical friction, combustion inefficiency, and exhaust gas pollution.

It is the purpose of this present invention, therefore, to improve and/or overcome the above-mentioned drawback in the manner set forth in the detailed description of the preferred embodiment.

SUMMARY OF THE INVENTION

This invention comprises a housing which is combined with a plurality of stators and outer rotors, and contains a central rotor with a shaft.

The central rotor is formed as a hollow frustum of right circular cone and has a plurality of curved channels formed on a first conical surface of a central portion thereof. A second conical surface of the rotor is formed at a front portion of the central rotor having a larger slope than that of the first conical surface, thus defining a space between the second conical surface and the housing to function as a combustion chamber.

The shaft is longitudinally inserted through the central rotor and rotatably supported and fixed by the housing with bearing means, and has a plurality of holes for coolant to flow therethrough.

Thus, when a mixture of fuel is ejected into the combustion chamber and is ignited by a spark plug, the ignited fuel expands and flows along the curved channel to rotate the central rotor.

Therefore, a primary object of the present invention is to provide a rotary engine which does not use seals in order to reduce mechanical friction.

Another object of this invention is to provide a rotary engine which eliminates motor oil in order to reduce exhaust pollutants.

A further object of this invention is to provide a rotary engine which has an improved mechanical efficiency.

DETAILED DESCRIPTION OF THE PREFERRED EMBODIMENT

Figure 12:
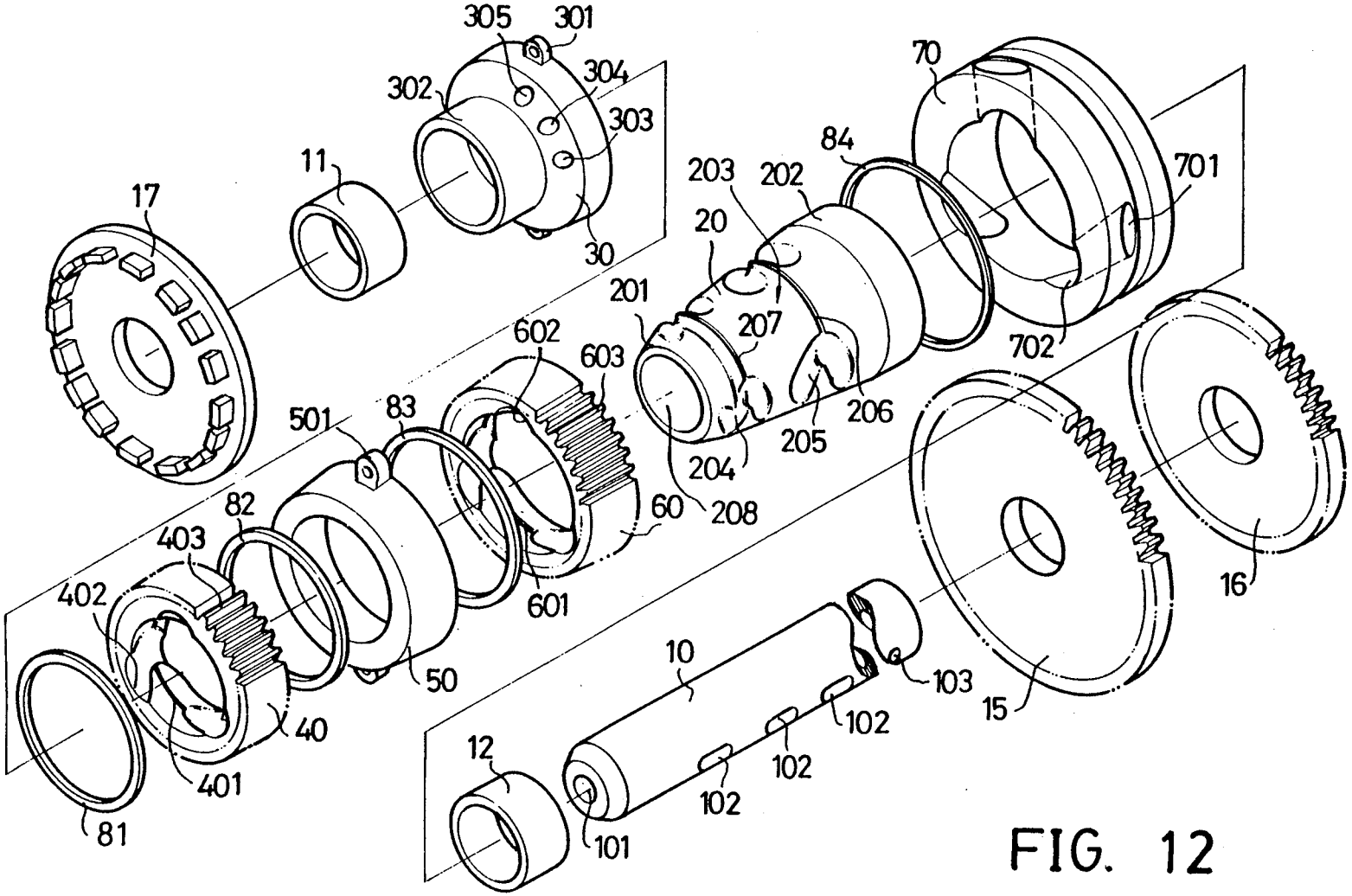
FIG. 12 is an exploded view of an internal combustion engine in accordance with this invention.
Figure 13:
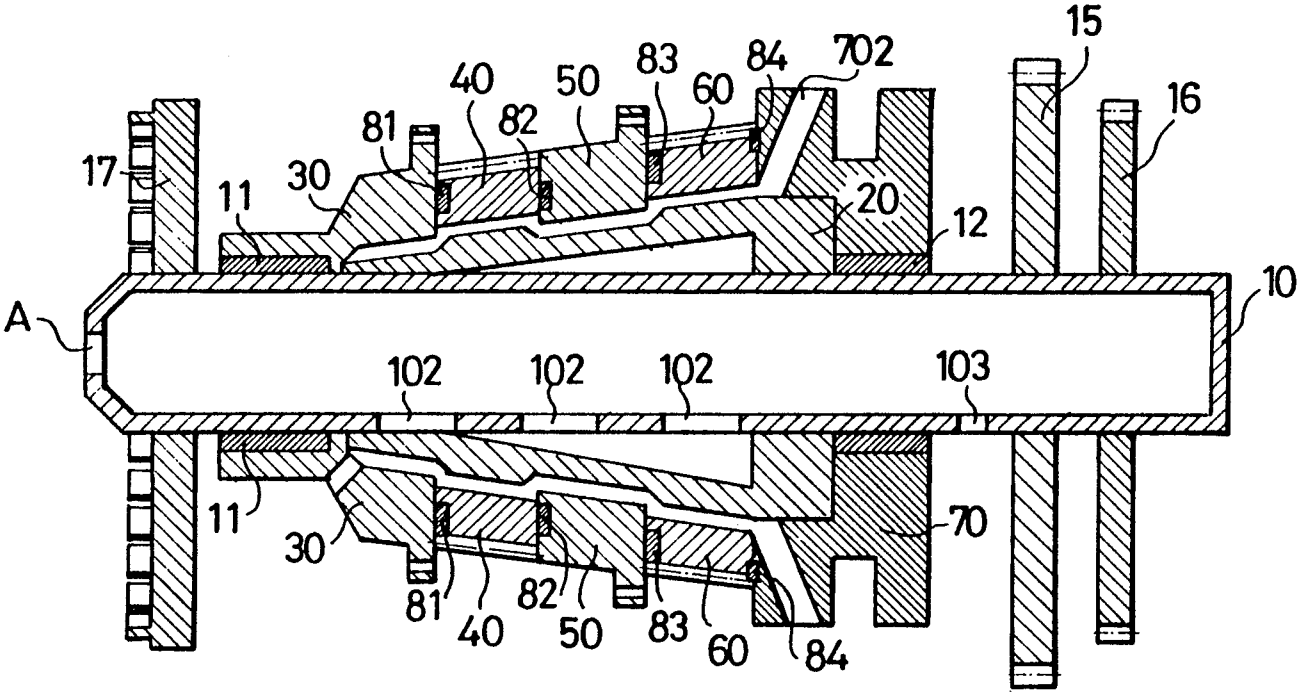
FIG. 13 is a lateral cross-sectional view of an internal combustion engine of the present invention.

Initially referring to FIGS. 12 and 13, an internal combustion rotary engine in accordance With the present invention is shown with an exploded view to illustrate all components thereof.

A hollow shaft 10 has a plurality of holes 102 in a peripheral surface thereof and an exit 101 at an end and an inlet 103 at another side thereof.

A central rotor 20 is formed as a frustum, has a center hole 208, and is fixedly engaged with the shaft 10 by inserting the shaft 10 through the center hole 208 of the central rotor 20.

Figure 4:
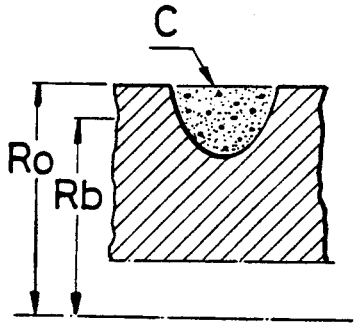
FIG. 4 is a cross-sectional view of a channel formed on a central rotor, wherein $R_o$, $R_b$, and C are a radius, a effective rotating radius of a rotor, and combusted gas, respectively.
Figure 5:
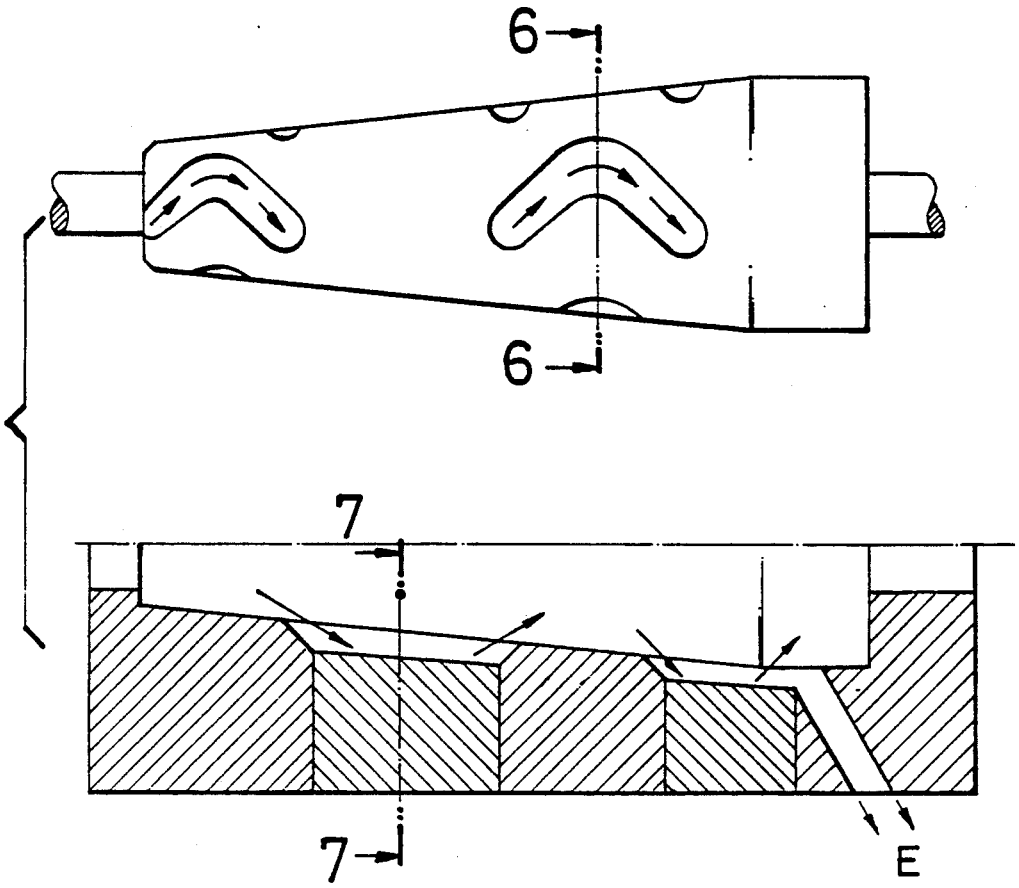
FIG. 5 is a spatial deployment of combustion channels in accordance with this invention, wherein a housing portion is shown in a half cross-sectional view.

Further, the central rotor 20 has a substantially conical surface which may be divided into three portions. A first conical surface 203 on a middle portion of the central rotor 20 has N columns spaced evenly around a surface thereof. (In a preferred embodiment, N equals three.) Each column has at least two curved channels, such as 204 and 205, and the curved channel is preferably V-shaped and has a U-shaped cross section, such as shown in FIGS. 4 and 5.

It is noted that fore ends of the front V-shaped channels merged into a second conical surface 201, which is on a front portion and has a larger slope than that of the first conical surface 203. The third portion of the conical surface of the central rotor 20 is preferably formed as a cylindrical surface 202.

Moreover, there are provided transverse slots 206 and 207 between each V-shaped channel in the same row to connect the V-channels in order to balance pressure in the channels.

A housing of a rotary engine in accordance with this invention includes at least one outer rotor and a plurality of stators, and in a preferred embodiment of this invention, there are two outer rotors and three stators, such as shown in FIG. 13.

A first stator 30 serves as a cap and comprises a plurality of fixing lugs 301, which are mounted to an engine seat (not shown); a protruding cylindrical flange 302, which receives a bearing 11 for supporting the shaft 10; and three ports 303, 304 and 305 which function as intake ports and a spark plug port respectively.

A second stator 50 has a smooth conical inner surface and a plurality of fixing lugs on an outer peripheral thereof to be secured to an engine frame (not shown).

A third stator 70 has a cylindrical inner surface and a plurality of exhaust passages 702 which extend from inner cut-out and joint exhaust port 701.

The first outer rotor 40 has a plurality of V-shaped channels 402 on an inner wall thereof that correspond to the V-shaped channels on the central rotor 20. The V-shaped channels 402 are similar to the V-shaped channels 205 but are in a reversed direction. There are also provided a transverse slot 401 to connect each V-shaped channel 402 in order to balance pressure in each V-shaped channel 402. The second outer rotor 60 is similar to the first outer rotor 40 but has a larger diameter.

Moreover, outer surfaces of the first and second outer rotors 40 and 60 may be attached or formed as a drive element to actuate a certain component, such as an air conditioner or air compressor.

Figure 6:
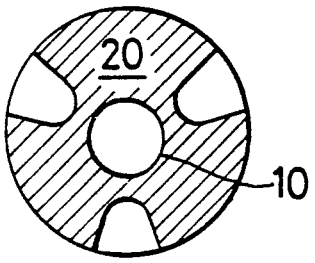
FIG. 6 is a cross-sectional view taken at line 6—6 in FIG. 5 to show the channels on a central rotor.
Figure 7:
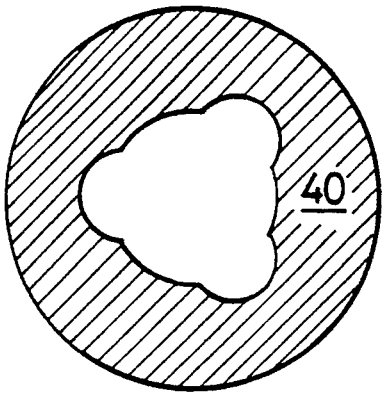
FIG. 7 is a cross-sectional view taken at line 7—7 in FIG. 5 to show the channels on an outer rotor of a housing.

The stators 30, 50, and 70 and outer rotors 40 and 60 are concentrically combined, referring to FIGS. 5, 6, and 7. And the V-shaped channels 402 on the first outer rotor 40 overlap rear ends of the front V-shaped channels 204 with one ends thereof, and overlap front ends of the rear V-shaped channels 205 with the other ends thereof. The second outer rotor 60 communicates the rear V-shaped channels to the exhaust passages 702 in a similar manner to the first outer rotor 40.

It is noted that concentric grooves are provided on ends of each stator and outer rotor to receive a gasket, such as 81, 82, 83, and 84 shown in FIG. 13, which serve as thrust bearings or seals.

When a mixture of fuel and gas is injected through the intake ports and ignited by the spark plug, a combusted gas expands and flows into the V-shaped channels.

Referring to FIGS. 1, 2, 3, and 4, the combusted gas is guided and limited by the V-shaped channel to advance in a specified curved space. In the angled portion of the V-shaped channel, the combusted gas rushes to and makes contact with a wall, thereby causing a change in velocity, which produces a torque in the central rotor 20 and actuates a load rotation of the central rotor 20. The symbols shown in FIGS. 1 to 4 are defined as follows:

| Symbols | Descriptions |
|---|---|
| Vx | Absolute velocity of combusted gas |
| U | Rotating speed of rotor |

-continued

| Symbols | Descriptions |
|---|---|
| Wx | Relative velocity of combusted gas |
| $Va_x$ | Axial velocity of combusted gas |
| Tx | Temperature |
| Px | Pressure |
| hx | Enthalpy |
| Cp | Constant-pressure specific heat of gas |

Figure 1:
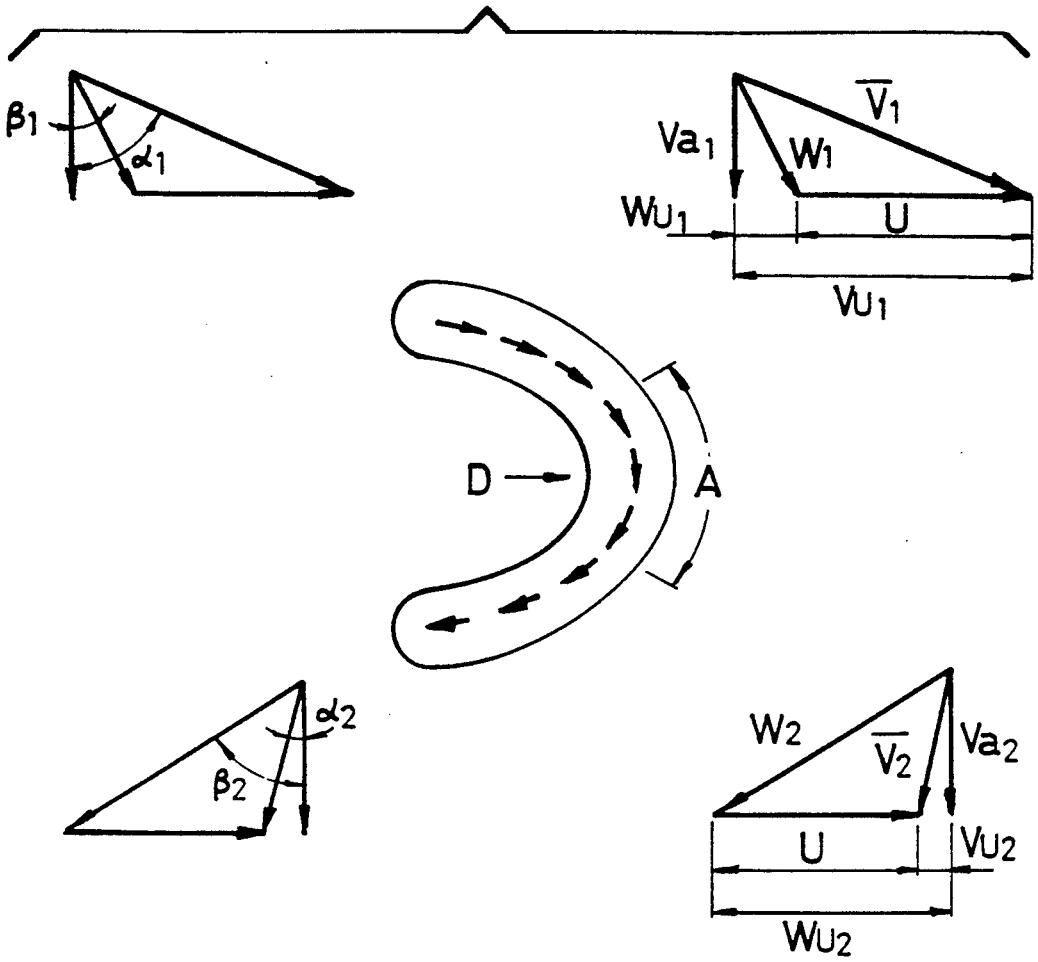
FIG. 1 is a velocity diagram at mean diameter for a rotor, wherein D and A are a direction of rotating and an angled portion of a V-shaped channel respectively.
Figure 2:
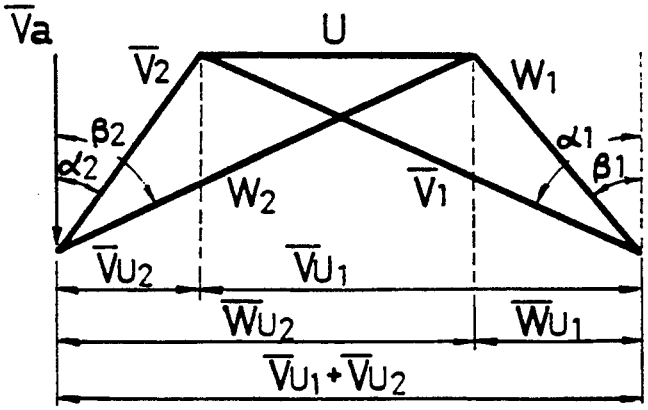
FIG. 2 is a stage velocity diagram for a rotor with constant axial velocity.
Figure 3:
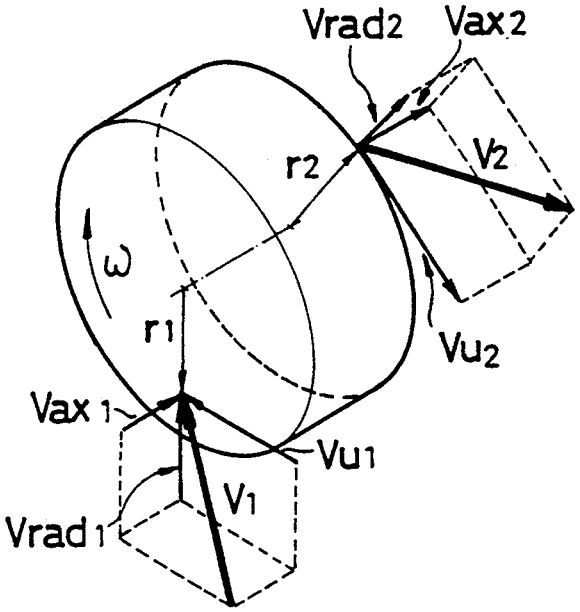
FIG. 3 is a diagram illustrating flowing of a fluid for entering and exiting a rotor

In a rotary engine the velocity of a combusted gas, as shown in FIG. 3, at a given point may be divided into three mutual perpendicular components: the radial velocity, Vrad; the tangential velocity, Vt; and the axial velocity, Va. The tangential velocity of the rotor is expressed as follows:

$$Vt = U = r \cdot w$$

wherein r is the radius of the rotor and w is the angular velocity thereof.

In this invention, a characteristic of each point on a vertical cross-section of the combusted gas is homogeneous, while a flowing direction thereof continues changing such as shown in FIG. 4, assuming that differences of height, pressure, heat transfer, and friction loss in piping are neglected. Thus, the driving motion of the gas can be simplified to one dimensional motion. A principle of the motion above mentioned and relationship of the energy, velocity, and temperature are described as follows, wherein velocity is expressed as a vector:

1. Change in velocity of the combusted gas:

$$\Delta V = V_2 - V_1$$

2. Motion of the central rotor caused by the force of the combusted gas:

$$V_c - \Delta V = -(V_2 - V_1) = V_1 - V_2$$

3. According to a fluid motion equation, the axial velocity being the same:

$$Va_1 = Va_2 = Va$$

4. Change in velocity expressed with an equation of axial velocity, enter and exit angle:

$$Vc_1 = Vu_2 + Vu_1 = Va[\tan(\alpha_1) + \tan(\alpha_2)]$$

5. Assuming steady state, fluid mass m and flow rate $\dot{m}$ (the force impacted by the fluid to the central rotor):

$$F = P = d(mV)/dt = \dot{m}(V)$$

6. Torque of the central rotor:

$$T = FR_b = \dot{m}R_b Vc_1 = \dot{m}R_b Va[\tan(\alpha_1) + \tan(\alpha_2)]$$

7. Motive energy of the central rotor:

$$W_s = T \cdot w = F \cdot R_b w = F \cdot U = \dot{m}UVc = \dot{m}UVa[\tan(\alpha_1) + \tan(\alpha_2)]$$

8. Relation between consumed energy of fluid and motive energy of the rotor:

$$W_s = \dot{m}(h_{t1} - h_{t2}) = \dot{m}Cp(T_1 - T_2)$$

Figure 8:
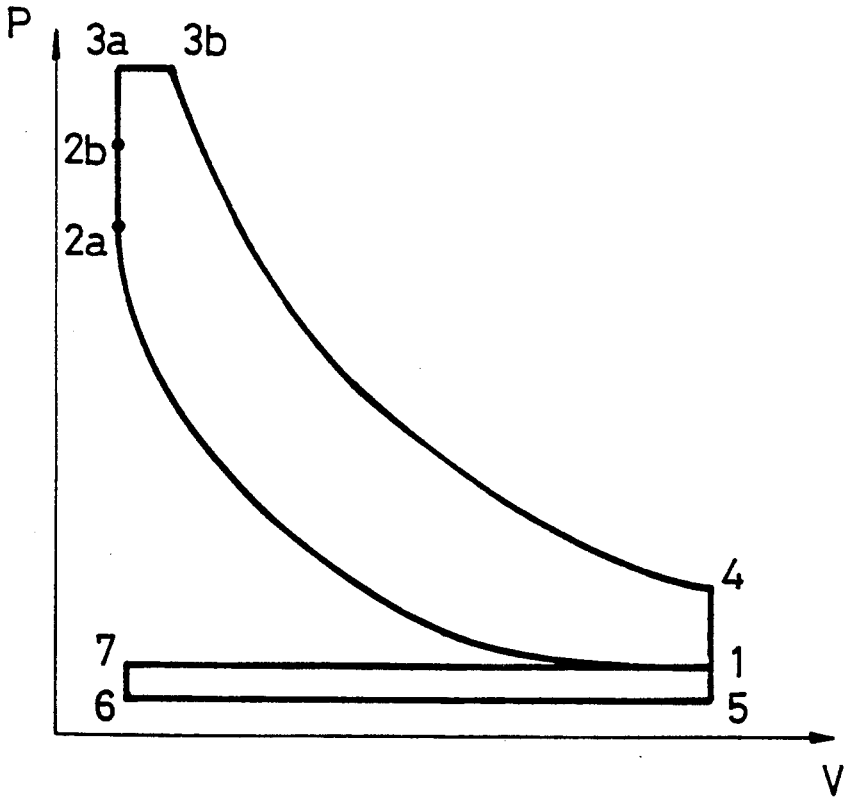
FIG. 8 is a pressure-volume diagram during a combustion cycle of an internal combustion engine of this invention.

When the combusted flame gas rushes into the V-shaped channel, the central rotor 20 rotates. At an end of the front channel the flame gas rushes into a V-shaped channel of the first outer rotor 40 and rotates the outer rotor 40 in a reversed direction to that of the central rotor 20. In a same manner, the combusted gas flows through the rear V-shaped channel on the central rotor 20 and through the second outer rotor 60, and then through the exhaust passage 702 to a exhaust manifold (not shown). A pressure-volume diagram is shown in FIG. 8, wherein the curve from 1 to 2*a* indicates a compressing procedure occurring in a pressure booster (not shown); 2*a* to 2*b*, an injection process; 2*b* to 3*a*, a combustion process; 3*a* to 4, a power process; 4 to 5 to 6, an exhausting process; and 6 to 7 to 1, an intake process occurring in the booster.

Therefore, the combusted gas rotates the rotors in a manner of an M cascade-type arrangement during a rotation cycle; in the preferred embodiment M is equal to four (two for the central rotor, two for the outer rotors). It is noted that M is never less than three.

Figure 9:
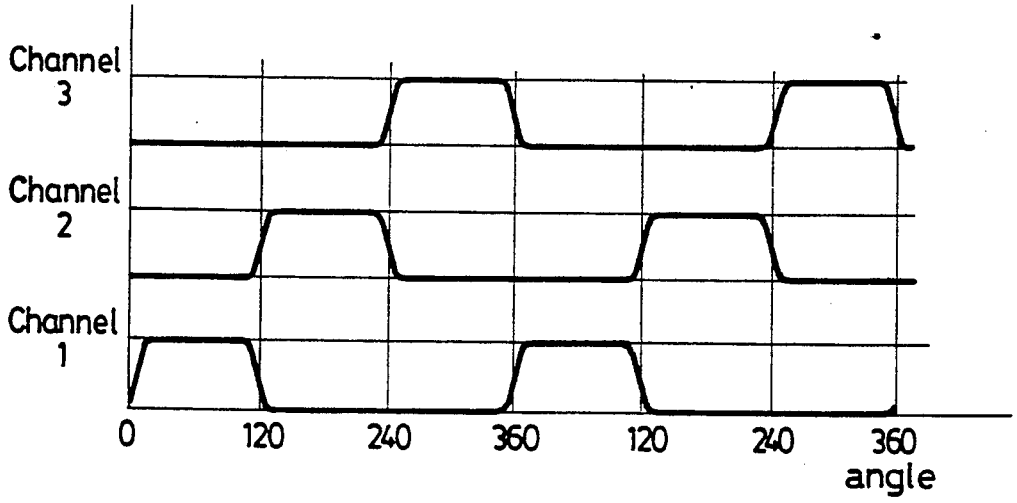
FIG. 9 is an intake rotating angle diagram of an internal combustion engine of this invention.
Figure 10:
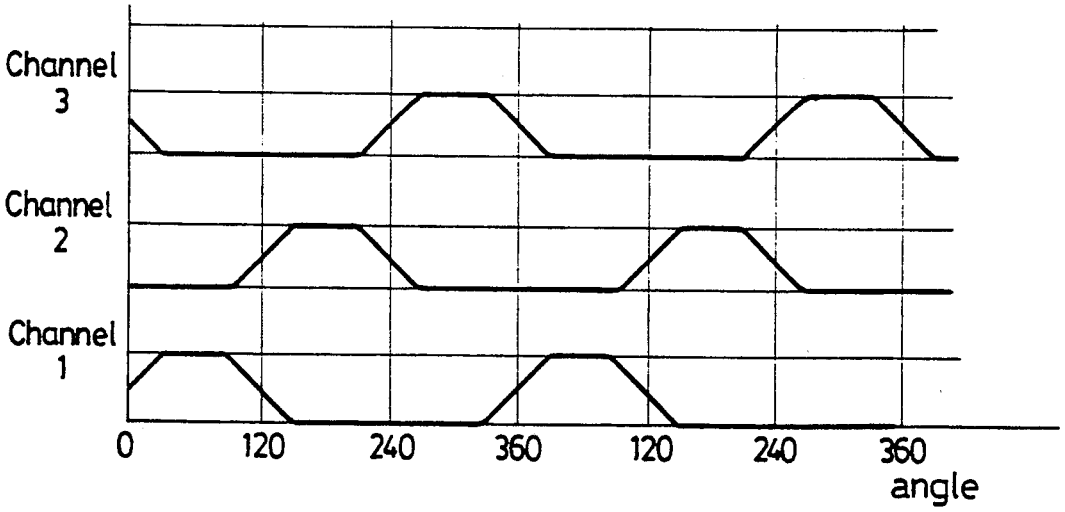
FIG. 10 is an exhaust rotating angle diagram of an internal combustion engine of this invention.

The central rotor 20 rotates in the housing. Each time the front end of the V-shaped channel of the central rotor 20 passes the intake port 303, a fuel mixture is drawn in, and the compressed air being injected through the intake port 304. The mixture is then ignited, and expanded to repeat the rotation cycle. Thus, it is a bunch-type intermittent combustion sequence for the V-shaped channel, such as shown in FIGS. 9 and 10.

Figure 11:
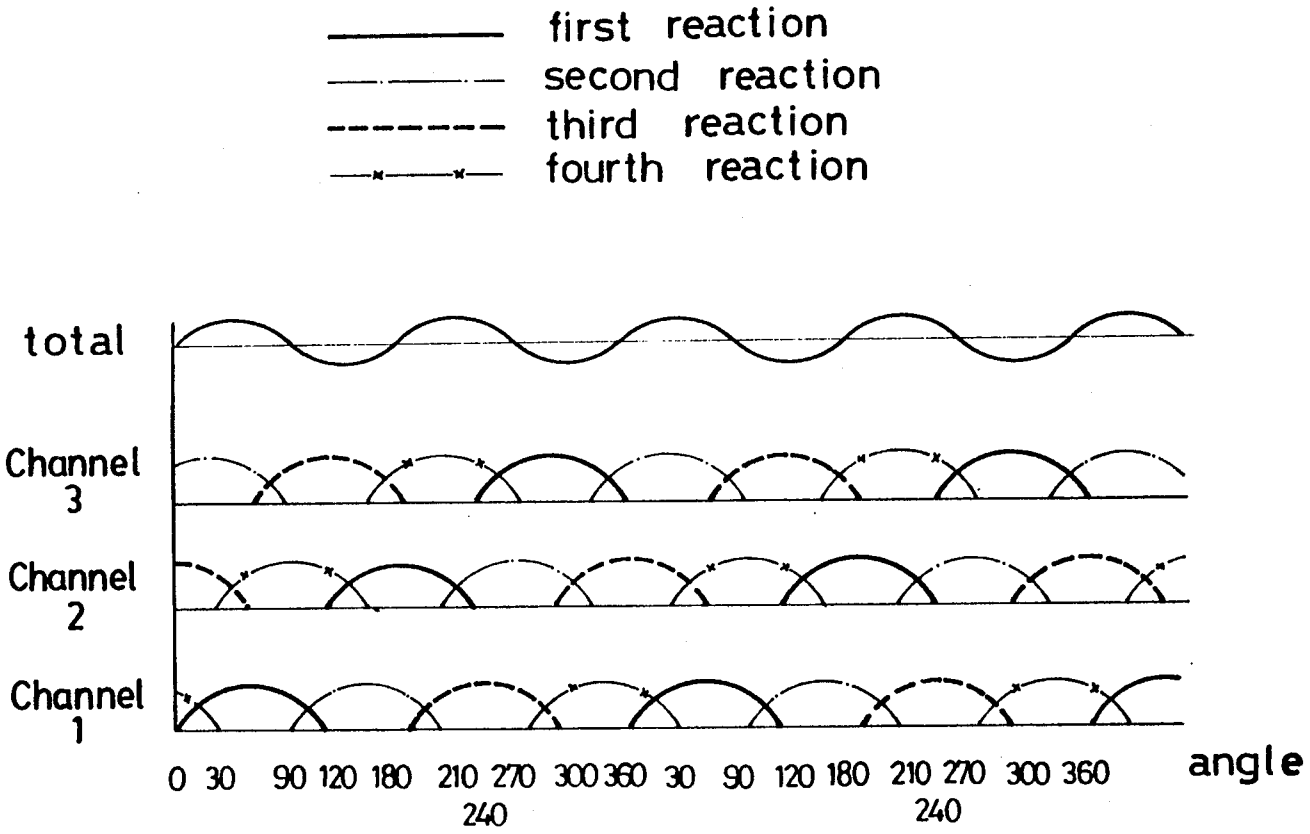
FIG. 11 is an output power diagram of an internal combustion engine of this invention.

Since the N rows of V-shaped channels coupled with M angled portions cause an overlapping effect, a smooth and continuous output of power could be expected, such as shown in FIG. 11.

Furthermore, since the shaft 10 rotates coincidentally with the central rotor 20, an encoder 17 may be fixedly mounted to a front portion of the shaft 10 to serve for a signal source to monitor angular velocity. Also, a rear portion the shaft 10 may engage with a flywheel 15 and clutch 16 to be engaged with a starter motor (not shown) and to transmit power from the shaft 10 to a transmission (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. An internal combustion rotary engine comprising:

an internal combustion chamber wherein a combustible fuel-air mixture is ignited for producing a driving gas flow;

a central rotor having an outer surface in which at least one group of curved channels circumferentially-and-axially extending without radially extending through said central rotor; and at least one annular rotor each enclosing said central rotor having an inner surface in which a corresponding number of curved channels circumferentially-and-axially extending without radially extending through said at least one annular rotor;

when said curved channels in said central rotor communicate with said curved channels in said at least one annular rotor, the driving gas flow circumferentially-and-axially passing between said outer surface of said central rotor and said inner surface of said at least one annular rotor for rotating said central rotor and said at least one annular rotor in opposite directions.

2. An internal combustion rotary engine comprising:

an internal combustion chamber wherein a combustible fuel-air mixture is ignited for producing a driving gas flow;

a central rotor having an outer surface in which (a) a plurality of first curved channels circumferentially-and-axially extending without radially extending through said central rotor, each said first curved channel having an inlet for inducing the driving gas flow from said internal combustion chamber and an outlet and (b) a corresponding number of second curved channels circumferentially-and-radially extending without radially extending through said central rotor, each said second curved channel having an inlet and an outlet;

a first annular rotor enclosing said central rotor and having an inner surface in which a corresponding number of curved channels circumferentially-and-radially extending without radially extending through said first annular rotor, each said curved channel having an inlet for inducing the driving gas flow from said outlet of a corresponding one of said first channels and an outlet for inducing the driving gas flow to said inlet of a corresponding one of said second channels; and a second annular rotor enclosing said central rotor and having an inner surface in which a corresponding number of curved channels circumferentially-and-axially extending without radially extending through said second annular rotor, each said curved channel having an inlet for inducing the driving gas flow from said outlet of a corresponding one of said second channels and an outlet for inducing the driving gas flow to an exhaust;

when said first curved channels communicate with said channels in said first annular rotor communicating with said second curved channels communicating with said channels in said second annular rotor, the driving gas flow circumferentially-and-axially passing through said outer surface of said central rotor and said inner surfaces of said annular rotors for rotating said central rotor and said at least one annular rotor in opposite directions.

3. An internal combustion rotary engine in accordance with claim 2, wherein said curved channels in said annular rotors have opposite configurations relative to said curved channels in said central rotor.

4. An internal combustion rotary engine in accordance with claim 2, wherein said internal combustion chamber is defined between a cap and said central rotor.

5. An internal combustion rotary engine in accordance with claim 2, wherein said central rotor is a conical frustum having a periphery consisting of three sections including the first section with the largest slope, the second section with the middle slope and the third section with the smallest slope when said central rotor is disposed horizontal.

6. An internal combustion rotary engine in accordance with claim 5, wherein said internal combustion chamber is defined between a cap and said first section of said central rotor.

7. An internal combustion rotary engine in accordance with claim 5, wherein said first and second curved channel extend in said second section of said central rotor.

8. An internal combustion rotary engine in accordance with claim 6, wherein said first central rotor hermetically matches said cap.

9. An internal combustion rotary engine in accordance with claim 6, further comprising an annular stator hermetically sandwiched between said first and second annular rotors.

10. An internal combustion rotary engine in accordance with claim 5, wherein said exhaust is defined in an annular seat hermetically matching said second annular rotor.

11. An internal combustion rotary engine in accordance with claim 2, further comprising a first groove for communicating said first channels with each other and a second groove for communicating said second channels with each other.

* * * * *